US007072479B2

(12) United States Patent
Okita

(10) Patent No.: US 7,072,479 B2
(45) Date of Patent: Jul. 4, 2006

(54) CAPACITOR MICROPHONE

(75) Inventor: Shioto Okita, Sagamihara (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 388 days.

(21) Appl. No.: 10/336,918

(22) Filed: Dec. 26, 2002

(65) Prior Publication Data

US 2005/0094831 A1 May 5, 2005

(30) Foreign Application Priority Data

Jan. 11, 2002 (JP) ..... 2002-004321

(51) Int. Cl.
*H04R 25/00* (2006.01)

(52) U.S. Cl. ..... 381/174; 381/369; 381/191

(58) Field of Classification Search ..... 381/174–175, 381/176, 399, 191, 113, 116; 367/140, 170, 367/181; 29/25.41, 25.42, 594
See application file for complete search history.

(56) References Cited

U.S. PATENT DOCUMENTS 3,859,477 A * 1/1975 Skvor ..... 381/163
4,117,275 A * 9/1978 Miyanaga et al. ..... 381/174
6,366,678 B1 * 4/2002 Madaffari et al. ..... 381/324
6,678,383 B1 * 1/2004 Ito et al. ..... 381/174
6,741,709 B1 * 5/2004 Kay et al. ..... 381/175
2003/0118203 A1 * 6/2003 Raicevich ..... 381/174
2003/0123683 A1 * 7/2003 Raicevich ..... 381/174

* cited by examiner

*Primary Examiner*—Sinh Tran
*Assistant Examiner*—Phylesha Dabney
(74) *Attorney, Agent, or Firm*—Welsh & Katz, Ltd.

(57) ABSTRACT

The present invention relates to a capacitor microphone which is characterized that even in a microphone with a small diameter such as a lavalier microphone, the noneffective electrostatic capacitance enables to be decreased and a better signal-to-noise ratio enables to be obtained.

As shown in FIG. 2, in the capacitor microphone in which a vibration plate 10 strained and fixed on a support ring 11 and a charge back-plate 20 supported on one end-side of a cylinder base 21 face each other and are disposed through a spacer forming a gap, the spacer 30A having at least three spacer pieces, in which the each spacer piece has the same thickness and is disposed apart from the adjacent spacer pieces at generally equal angle on the same circumference, in place of the ring-shaped spacer.

2 Claims, 5 Drawing Sheets

CAPACITOR MICROPHONE

FIELD OF THE INVENTION

The present invention relates to a capacitor microphone in which a vibration plate vibrated by receiving a sound wave and a charge back-plate face each other and are arranged through a spacer. More specifically, the invention relates to a technique for minimizing a noneffective electrostatic capacitance.

BACKGROUND OF THE INVENTION

A capacitor microphone is a sort of electroacoustic converters which catch a mechanical displacement of a vibration plate vibrated by a sound wave as the variation of electrostatic capacitance and convert the variation of the electrostatic capacitance to an electric signal. In a prior art, a capacitor microphone provides a vibration plate (diaphragm) 10 and a charge back-plate (fixed charge-plate) 20 as shown in a sectional view of FIG. 9 and in an exploded-perspective view of FIG. 10.

The vibration plate 10 is composed of a thin film such as polyphenylene sulfide (PPS) and is strained with a given tensile force and fixed on one end-face of a support ring (diaphragm ring) 11. The charge back-plate 20 is composed of matter such as an electret board and is fixed on one end-side of a cylinder base 21.

A spacer 30 is arranged between the vibration plate 10 and the charge back-plate 20 in order to form a capacitor. A plastic film such as polyethylene terephthalete (PET) punched in the shape of a ring is mostly used as the spacer 30.

Since the capacitor microphone has the directivity of an unidirectional polar pattern, rear acoustic terminals 21*a* are formed on the cylinder base 21. In the charge back-plate 20, through-holes 20*a* are punched in order to communicatively connect the rear acoustic terminals 21*a* to the reverse face side of the vibration plate 10.

As described above, in the capacitor microphone the capacitor is formed by disposing the spacer 30 between the vibration plate 10 and the charge back-plate 20. The capacitor includes both of an effective electrostatic capacitance which serves the generation of the electric power and a noneffective electrostatic capacitance which does not serve the generation of the electric power, and the greater is the effective electrostatic capacitance of the capacitor, the better is the signal-to-noise ratio of the capacitor microphone.

The noneffective electrostatic capacitance (stray electrostatic capacitance), which causes a capacitor microphone to reduce a gain, exists at the contact part of the spacer 30 and the charge back-plate 20. In the capacitor microphone having a comparatively greater diameter, it will be possible that a noneffective electrostatic capacitance is designed to be smaller relatively to an effective electrostatic capacitance.

However, in a capacitor microphone having a smaller diameter, particularly, in an electret capacitor microphone in which FEP should to be laminated on a charge back-plate, it is difficult to decrease the noneffective electrostatic capacitance. Especially, since in a microphone having a smaller diameter, such as a lavalier microphone (tie pin microphone), the effective electrostatic capacitance is originally smaller, the gain is considerably decreased by the noneffective electrostatic capacitance.

SUMMARY OF THE INVENTION

The subject matter of the present invention is to obtain a good signal-to-noise ratio by decrease the noneffective electrostatic capacitance, even in a microphone having a small diameter such as a lavalier microphone.

In order to solve the problems described above, the present invention is characterized that in a capacitor microphone in which a vibration plate strained and fixed on a support ring and a charge back-plate supported on one end-side of a cylinder base face each other and are disposed through a spacer forming a gap, at least three spacer pieces are provided in the spacer, each of which has the same thickness as the others and is arranged apart from the adjacent spacer pieces at generally equal angle on the same circumference and is desposed between the vibration plate and the charge back-plate.

According to this structure, since the contact area of the spacer and the charge back-plate becomes smaller, the noneffective electrostatic capacitance is decreased. According to a preferred specific form, the each of the spacer pieces is integrated and formed in the inner circumference side of the ring-shaped frame made from synthetic resin fitted in the outer circumference of the cylinder base or the support ring.

DETAILED DESCRIPTION OF THE PREFERRED EMBODIMENTS

Figure 1:
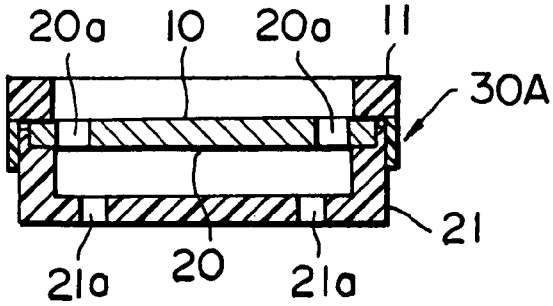
FIG. 1 is a sectional view of a capacitor microphone relating to an embodiment of the present invention.
Figure 2:
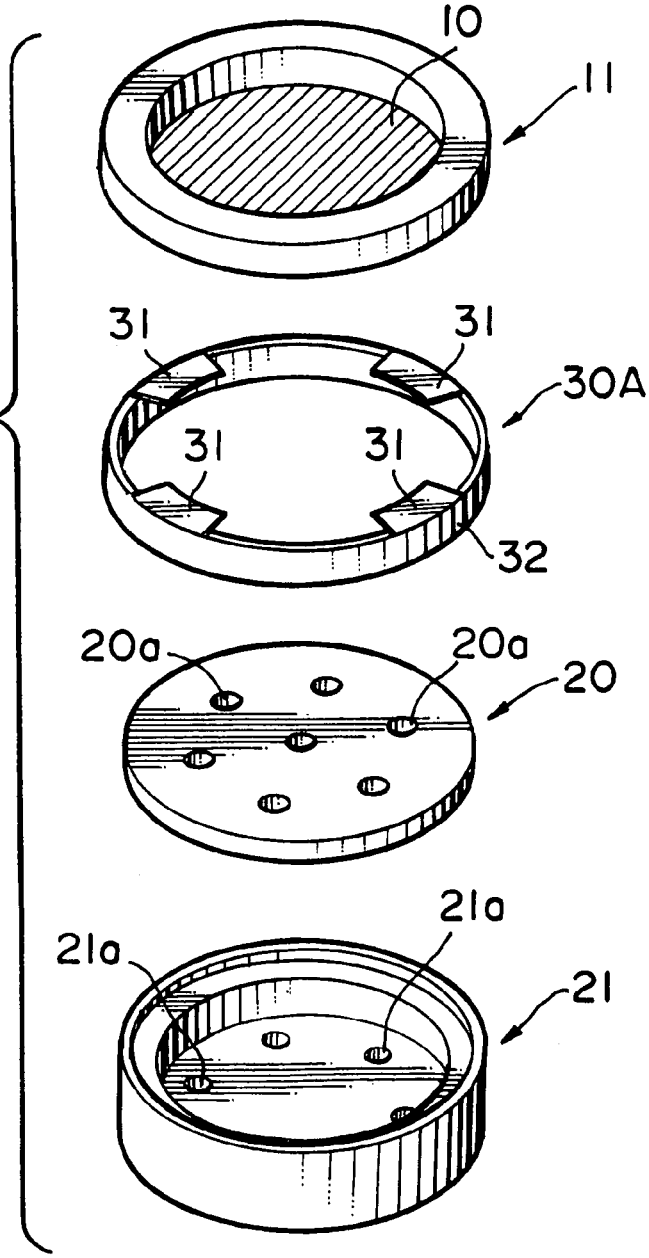
FIG. 2 is an exploded-perspective view of the capacitor microphone of the present invention.

With reference to the drawings, the present invention will be described. FIG. 1 is a generally sectional view of a capacitor microphone related to an embodiment of this invention and FIG. 2 is an exploded-perspective view thereof.

Figure 9:
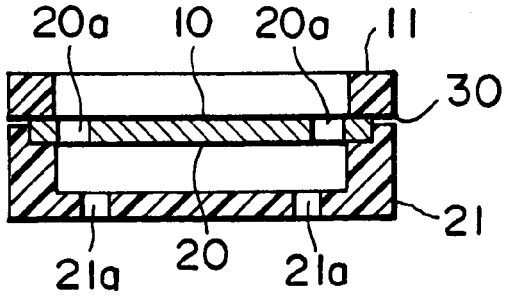
FIG. 9 PRIOR ART
FIG. 9 shows a sectional view of the capacitor microphone in the prior art.
Figure 10:
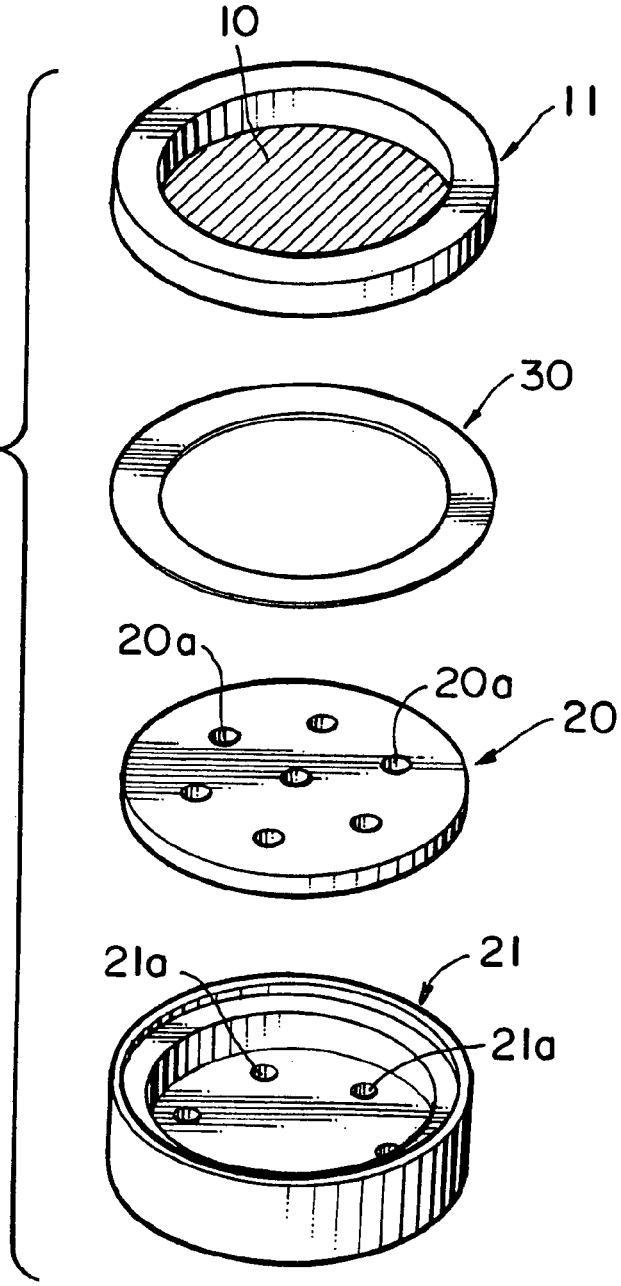
FIG. 10 PRIOR ART
FIG. 10 shows an exploded-perspective view of the capacitor microphone in the prior art.

In the capacitor microphone of this invention, a vibration plate 10, a support ring 11, a charge back-plate 20 and a cylinder base 21 may be the same as the ones in the capacitor microphone of the prior art described above in FIGS. 9 and 10. However, in this invention, a spacer 30A of the deferent structure is used for forming a capacitor between the vibration plate 10 and the charge back-plate 20.

That is, the spacer 30A is not ring-shaped (donut-shaped), and provides a plurality of spacer pieces 31 arranged apart from the adjacent spacer pieces at generally equal angle on the same circumference between the vibration plate 10 and the charge back-plate 20. The material of the spacer may be the same as the one in the prior art, such as PET and the thickness of the each spacer piece is all the same.

In this embodiment, the four spacer pieces 31 are arranged apart from the adjacent spacer pieces at approximately 90-degree and are integrated and formed with the ring-shaped frame 32 in order to increase workability of assembling and handling.

In this embodiment, the ring-shaped frame 32 is formed to fit in the outer circumference of the cylinder base 21 and therefore, once the ring-shaped frame 32 is put onto the cylinder base 21, each of the spacer pieces 31 may be partially arranged on the circumference of the charge back-plate 20, while, in place of fitting in the cylinder base, the ring-shaped frame 32 may be formed to be fitted in the outer circumference of the support ring 11.

Figure 3:
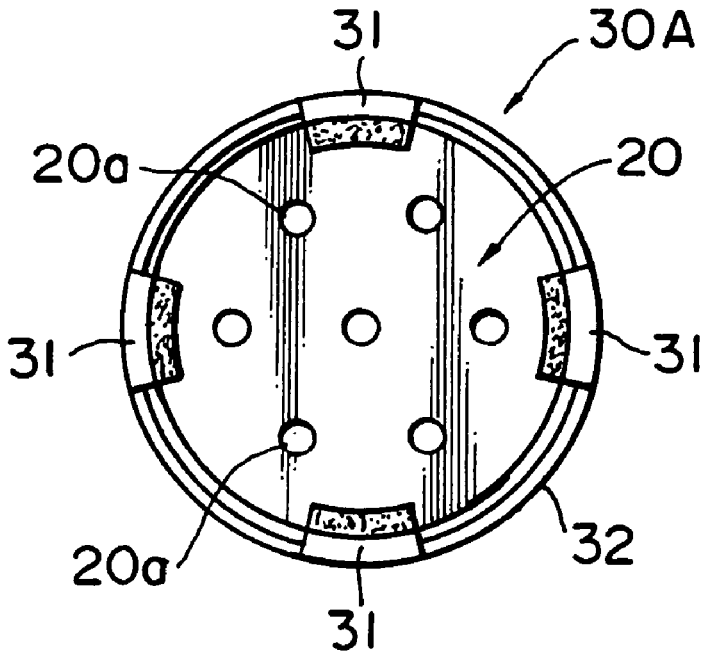
FIG. 3 is a plane view showing the spacer disposed on the charge back-plate of the capacitor microphone of the present invention.

In all cases described above, as shown in the plane view of FIG. 3, since the four spacer pieces 31 are partially arranged on the circumference of the charge back-plate 20, the contact area of the spacer 30A with the charge back-plate 20 may be decreased compared with the contact area of the ring-shaped spacer 30 of the prior art with the charge back-plate 20 (see FIG. 10), so that the noneffective electrostatic capacitance may be decreased.

Figure 4:
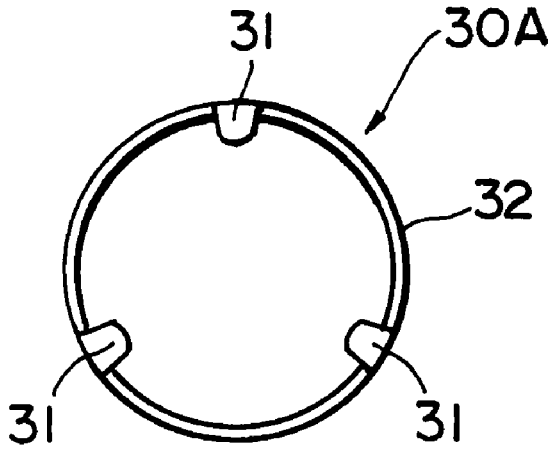
FIG. 4 is a plane view showing another embodiment of the spacer used in the capacitor microphone of the present invention.

In this embodiment described above, the number of the spacer pieces is four, however, in the present invention, it is sufficient that at least three spacer pieces are provided as shown in the plane view of FIG. 4. The noneffective electrostatic capacitance may be decreased much more by using the spacer with the three spacer pieces.

Therefore, according to this invention, the signal-to-noise ratio of the capacitor microphone may be improved by decreasing the noneffective electrostatic capacitance. The difference of the effect between the present invention and the prior art will be verified by a simulation based on actual values of the dimensions, relative permittivity, or the like.

Figure 5A:
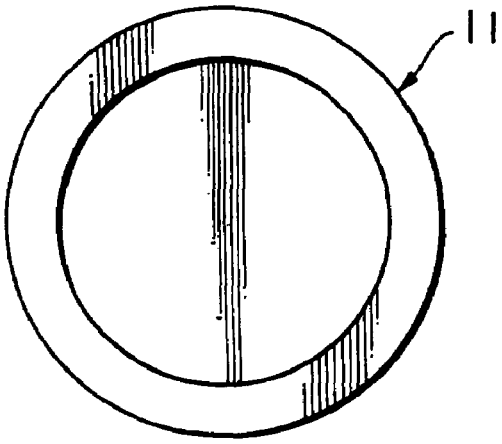
FIGS. 5(*a*) and 5(*b*) show a plane and a sectional views of the support ring, respectively, used in both of the prior art and the present invention.
Figure 5B:
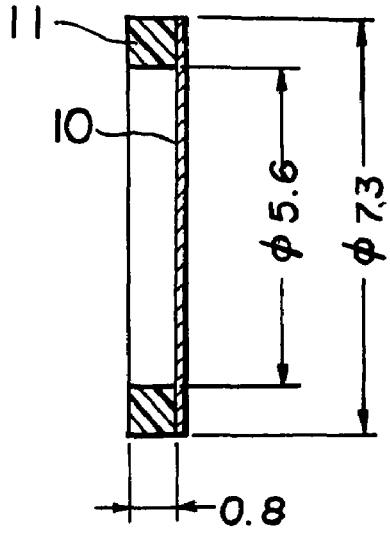

As shown in the plane view of FIG. 5(*a*) and the sectional view of FIG. 5(*b*), the support ring 11 in both of this invention and the prior art, has the outer diameter of 7.3 mm, the inner diameter of 5.6 mm and the thickness of 0.8 mm, on which the vibration plate (diaphragm) 10 made from PPS having the thickness of 2 μm and the relative permittivity $\epsilon$ s of 3.0 is strained with a given tensile force and fixed.

Figure 6A:
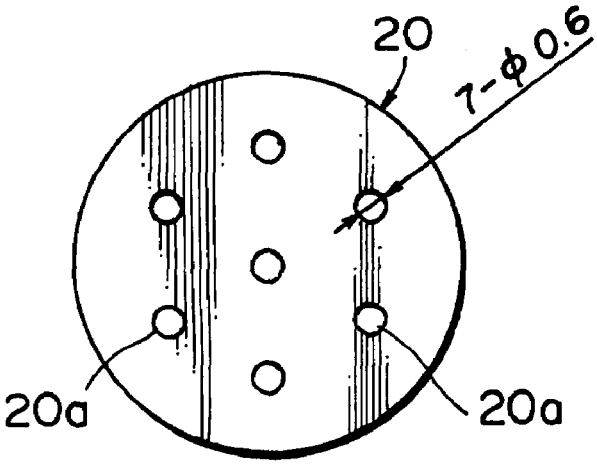
FIGS. 6(*a*) and 6(*b*) show a plane and a side elevational views of the charge back-plate, respectively, used in both of the prior art and the present invention.
Figure 6B:
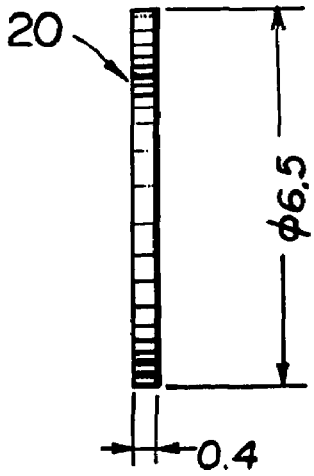

As shown in the plane view of FIG. 6(*a*) and the side elevational view of FIG. 6(*b*), in both of this invention and the prior art, the charge back-plate 20, which has the outer diameter of 6.5 mm and the thickness of 0.4 mm and has seven through-holes 20*a* having the inner diameter of 0.6 mm punched therethrough, is used.

Figure 7A:
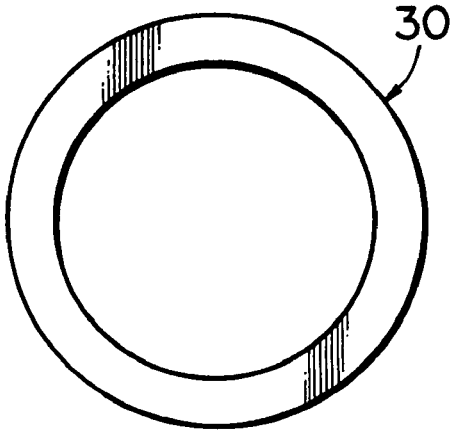
FIG. 7(a) PRIOR ART
FIGS. 7(*a*) and 7(*b*) show a plane and a sectional views of the spacer, respectively, used in the prior art.
Figure 7B:
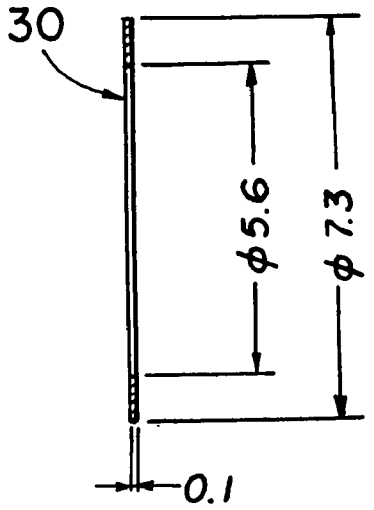
FIG. 7(b) PRIOR ART

In the prior art, as shown in the plane view of FIG. 7(*a*) and the sectional view of FIG. 7(*b*), a ring-shaped spacer made from PET which has the outer diameter of 7.3 mm, the inner diameter 5.6 mm, the thickness of 100 μm and the relative permittivity $\epsilon$ s of 3.0 is used as the spacer 30.

Figure 8A:
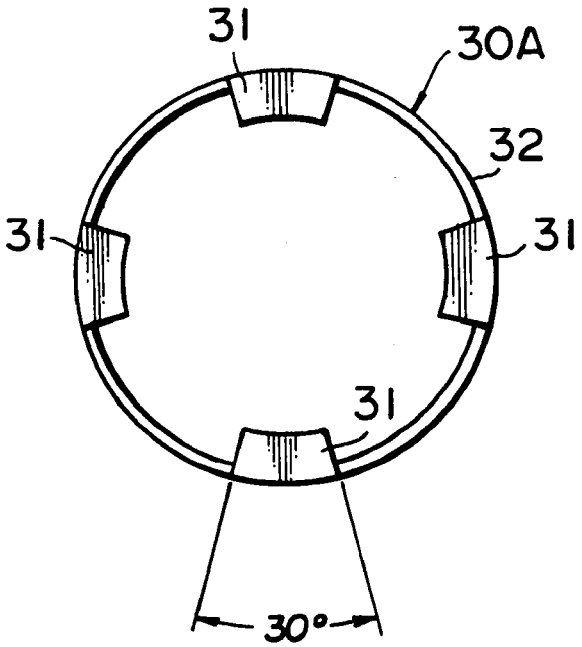
FIGS. 8(*a*) and 8(*b*) show a plane and a sectional views of the spacer, respectively, used in the present invention.
Figure 8B:
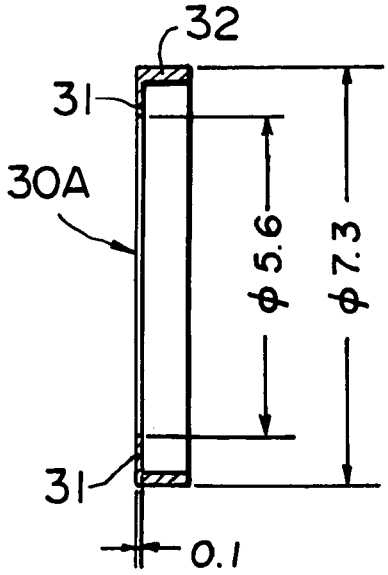

While, in this invention, as shown in the plane view of FIG. 8(*a*) and the sectional view of FIG. 8(*b*), the spacer of the relative permittivity $\epsilon$ s of 2.99 made from polycarbonate (PC) is used as the spacer 30A, in which four fan-shaped spacer pieces 31 having the fan-shaped open-angle of 30-degree of each piece, the thickness of 100 μm of each piece and the inner diameter of 5.6 mm, are arranged apart from the adjacent fan-shaped spacer pieces at 90-degree and are integrated and formed in the inner circumferential face side of the ring-shaped frame 32 having the outer diameter of 7.3 mm.

As the basic formula, the electrostatic capacity C is expressed by below equation 1. Where S is the area of a charge-plate, d is the distance between charge-plates, $\epsilon$ is the electric constant, and $\epsilon$ s is the relative permittivity between the charge-plates.

$$C=(S\times\epsilon\times\epsilon s)/d[F] \quad \text{(Equation 1)}$$

where $\epsilon=8.854\times10^{-12}$ [F/m] and MKS unit system is used.

According to above equation 1, the effective electrostatic capacitance and the noneffective electric capacitance in both portions of the vibration plate and the spacer will be calculated and consequently the values of the compound electrostatic capacitance in this invention and the prior art will be obtained respectively and compared.

The calculation of the electrostatic capacitance in the prior art will be described below.

The effective area of the electrostatic capacitance S1*b* on the basis of the calculation of the effective electrostatic capacitance in the prior art is the area of the charge back-plate 20 except the area of the seven through-holes 20*a*.

$$\begin{aligned} S1b &= (6.5\times10^{-3}/2)^2\pi-(0.6\times10^{-3}/2)^2\pi\times7 \\ &= 3.318\times10^{-5}-0.198\times10^{-5} \\ &= 3.12\times10^{-5}\ [\mathrm{m}^2] \end{aligned}$$

The noneffective area of the electrostatic capacitance S1*s* on the basis of the calculation of the noneffective electrostatic capacitance in the prior art is the overlapped area of the charge back-plate 20 and the spacer 30.

$$\begin{aligned} S1s &= (6.5\times10^{-3}/2)^2\pi-(5.6\times10^{-3}/2)^2\pi \\ &= 3.318\times10^{-5}-2.463\times10^{-5} \\ &= 0.285\times10^{-5}\ [\mathrm{m}^2] \end{aligned}$$

The calculation of the noneffective electrostatic capacitance in the prior art will be described below.

The noneffective electrostatic capacitance of the portion of the vibration plate C1*ds* is:

$$\begin{aligned} C1ds &= (0.855\times10^{-5}\times8.854\times10^{-12}\times3.0)/2\times10^{-6} \\ &= 1.14\times10^{-10}\ [\mathrm{F}] \\ &= 114\ [\mathrm{pF}] \end{aligned}$$

The noneffective electrostatic capacitance of the portion of the spacer C1*ss* is:

$$\begin{aligned} C1ss &= (0.855\times10^{-5}\times8.854\times10^{-12}\times3.0)/100\times10^{-6} \\ &= 0.23\times10^{-11}\ [\mathrm{F}] \\ &= 2.3\ [\mathrm{pF}] \end{aligned}$$

The total of the noneffective electrostatic capacitance C1*s* of the capacitor microphone in the prior art is the compound value with regard to the overlapped portions of the vibration plate and the spacer.

$$Cls = (C1ds \times C1ss)/(C1ds + C1ss)$$
$$= (114 \times 2.3)/(114 + 2.3)$$
$$\approx 2.3 \text{ [pF]}$$

The calculation of the effective electrostatic capacitance in the prior art will be described below.

The effective electrostatic capacitance of the portion of the vibration plate C1*db* is:

$$C1db = (3.12 \times 10^{-5} \times 8.854 \times 10^{-12} \times 3.0)/2 \times 10^{-6}$$
$$= 4.14 \times 10^{-10} \text{ [F]}$$
$$= 414 \text{ [pF]}$$

The effective electrostatic capacitance of the portion of the thin air-layer with regard to the spacer C1*sb* is:

$$C1sb = (3.12 \times 10^{-5} \times 8.854 \times 10^{-12})/100 \times 10^{-6}$$
$$= 0.28 \times 10^{-11} \text{ [F]}$$
$$= 2.8 \text{ [pF]}$$

The total of the effective electrostatic capacitance C1*b* of the capacitor microphone in the prior art is the compound value of the portions of the vibration plate and the thin air-layer.

$$Clb = (C1db \times C1sb)/(C1db + C1sb)$$
$$= (414 \times 2.8)/(414 + 2.8)$$
$$\approx 2.8 \text{ [pF]}$$

Therefore, the total electrostatic capacitance of the capacitor microphone in the prior art C1 is:

$$C1 = C1s + C1b = 2.3 + 2.8$$
$$= 5.1 \text{ [pF]}$$

The loss of the electrostatic capacitance of the prior art A1 is:

$$A1 = C1b/C1 = 0.55$$
$$= -5.2 \text{ [dB]}$$

The calculation of the electrostatic capacitance in this invention will be described below.

The effective area of the electrostatic capacitance S2*b* on the basis of the calculation of the effective electrostatic capacitance of this invention is the area of the charge back-plate 20 except the area of the seven through-holes 20*a*.

$$S2b = (6.5 \times 10^{-3}/2)^2\pi - (0.6 \times 10^{-3}/2)^2\pi \times 7$$
$$= 3.318 \times 10^{-5} - 0.198 \times 10^{-5}$$
$$= 3.12 \times 10^{-5} \text{ [m}^2\text{]} \text{ (equivalent to the value in the prior art)}$$

The noneffective area of the electrostatic capacitance S2*s* on the basis of the calculation of the noneffective electrostatic capacitance of this invention is the overlapped area of the charge back-plate 20 and the spacer 30A. The area S2*s* is one-third of the area S1*s* in the prior art.

$$S2s = \{(6.5 \times 10^{-3}/2)^2\pi - (5.6 \times 10^{-3}/2)^2\pi\}/3$$
$$= (3.318 \times 10^{-5} - 2.463 \times 10^{-5})/3$$
$$= 0.285 \times 10^{-5} \text{ [m}^2\text{]}$$

The calculation of the noneffective electrostatic capacitance in this invention will be described below.

The noneffective electrostatic capacitance of the portion of the vibration plate C2*ds* is:

$$C2ds = (0.285 \times 10^{-5} \times 8.854 \times 10^{-12} \times 3.0)/2 \times 10^{-6}$$
$$= 0.379 \times 10^{-10} \text{ [F]}$$
$$= 37.9 \text{ [pF]}$$

The noneffective electrostatic capacitance of the portion of the spacer C2*ss* is:

$$C2ss = (0.285 \times 10^{-5} \times 8.854 \times 10^{-12} \times 2.99)/100 \times 10^{-6}$$
$$= 0.08 \times 10^{-11} \text{ [F]}$$
$$= 0.8 \text{ [pF]}$$

The total of the noneffective electrostatic capacitance C2*s* of the capacitor microphone in this invention is the compound value with regard to the overlapped portions of the vibration plate and the spacer.

$$C2s = (C2ds \times C2ss)/(C2ds + C2ss)$$
$$= (37.9 \times 0.8)/(37.9 + 0.8)$$
$$\approx 0.8 \text{ [pF]}$$

The calculation of the effective electrostatic capacitance in this invention will be described below.

The effective electrostatic capacitance of the portion of the vibration plate C2*db* is:

$$C2db = (3.12\times10^{-5}\times8.854\times10^{-12}\times3.0)/2\times10^{-6}$$

$$= 4.14\times10^{-10}\ [\mathrm{F}]$$

$$= 414\ [\mathrm{pF}]\quad \text{(equivalent to the value in the prior art)}$$

The effective electrostatic capacitance of the portion of the thin air-layer with regard to the spacer C2*sb* is:

$$C2sb = (3.12\times10^{-5}\times8.854\times10^{-12})/100\times10^{-6}$$

$$= 0.28\times10^{-11}\ [\mathrm{F}]$$

$$= 2.8\ [\mathrm{pF}]\quad \text{(equivalent to the value in the prior art)}$$

The total of the effective electrostatic capacitance C2*b* of the capacitor microphone in this invention is the compound value of the portions of the vibration plate and the thin air-layer.

$$C2b = (C2db\times C2sb)/(C2db + C2sb)$$

$$= (414\times2.8)/(414+2.8)$$

$$\approx 2.8\ [\mathrm{pF}]\quad \text{(equivalent to the value in the prior art)}$$

Therefore, the total electrostatic capacitance of the capacitor microphone in this invention C2 is:

$$C2 = C2s + C2b = 0.8 + 2.8$$

$$= 3.6\ [\mathrm{pF}]$$

The loss of the electrostatic capacitance of this invention A2 is:

$$A2 = C2b/C2 = 0.78$$

$$= -2.2\ [\mathrm{dB}]$$

As described above, the loss of the electrostatic capacitance in the prior art A1 is −5.2 dB while the loss of the electrostatic capacitance in this invention A2 is −2.2 dB, so that the signal-to-noise ratio of 3 dB may be improved in this invention.

According to the present invention, in the capacitor microphone in which the vibration plate strained and fixed on the support ring and the charge back-plate supported on one end-side of the cylinder base face each other and are arranged through the spacer forming a gap, the noneffective electrostatic capacitance even in a microphone with a small diameter such as a lavalier microphone enables to be decreased and the better signal-to-noise ratio enables to be obtained by using at least three spacer pieces, each of which has the same thickness as one of the other pieces and is arranged apart from the adjacent spacer pieces at generally equal angle on the same circumference, in place of the ring-shaped spacer.

The invention claimed is:

1. A capacitor microphone in which a vibration plate strained and fixed on a support ring and a charge back-plate supported on a side of a cylinder base, said support ring and said charge back-plate having adjacent first and second faces respectively and supported by a spacer forming a gap, comprising:

at least three spacer pieces included in the spacer, in which each of the spacer pieces has the same thickness and is spaced equidistant from adjacent spacer pieces on the periphery of said spacer; and wherein each of the spacer pieces is of a thickness less than a thickness of said spacer and contacts both of said first and second faces.

2. A capacitor microphone according to claim 1, wherein each of the spacer pieces is integrated and formed in an inner circumference side of a ring-shaped frame made from synthetic resin fitted in an outer circumference of the cylinder base of the support ring.

* * * * *